US010189268B2

(12) United States Patent
Berbiguier et al.

(10) Patent No.: US 10,189,268 B2
(45) Date of Patent: Jan. 29, 2019

(54) SOLVENT OR INK CONTAINER PLUG

(71) Applicant: Dover Europe Sàrl, Vernier (CH)

(72) Inventors: Mathieu Berbiguier, Guilherand Granges (FR); Vincent Audouard, Toulaud (FR)

(73) Assignee: DOVER EUROPE SARL, Vernier (CH)

( * ) Notice: Subject to any disclaimer, the term of this patent is extended or adjusted under 35 U.S.C. 154(b) by 0 days.

(21) Appl. No.: 15/868,555

(22) Filed: Jan. 11, 2018

(65) Prior Publication Data

US 2018/0134044 A1 May 17, 2018

Related U.S. Application Data

(63) Continuation of application No. 15/195,255, filed on Jun. 28, 2016, now Pat. No. 9,902,167.

(30) Foreign Application Priority Data

| | | |
|---|---|---|
| Jun. 29, 2015 | (FR) | 15 56072 |
| Nov. 30, 2015 | (CN) | 2015 2 0973555 U |
| Nov. 30, 2015 | (CN) | 2015 2 0973592 U |

(51) Int. Cl.

| | |
|---|---|
| ***B41J 2/20*** | (2006.01) |
| ***B41J 2/185*** | (2006.01) |
| ***B41J 2/165*** | (2006.01) |

(52) U.S. Cl.
CPC ..... *B41J 2/20* (2013.01); *B41J 2/16552* (2013.01); *B41J 2/185* (2013.01)

(58) Field of Classification Search
CPC ..... B41J 2/16552; B41J 2/185
See application file for complete search history.

(56) References Cited

U.S. PATENT DOCUMENTS 5,586,588 A * 12/1996 Knox ..... B67D 1/04 141/18
6,227,659 B1 5/2001 Lopez et al.
(Continued)

FOREIGN PATENT DOCUMENTS

| | | |
|---|---|---|
| EP | 1 080 929 A2 | 3/2001 |
| JP | H11-042795 A | 2/1999 |
| JP | 2008-087288 A | 4/2008 |

OTHER PUBLICATIONS

European Search Report issued in Patent Application No. Ep 16 17 6485 dated Nov. 15, 2016.
(Continued)

*Primary Examiner* — Juanita D Jackson
(74) *Attorney, Agent, or Firm* — Pearne & Gordon LLP

(57) ABSTRACT

A solvent or ink container plug includes a cylindrical base having an upper side and a lower side, the lower side being configured to face an inside of a container when the container is closed by the plug. The plug further includes a connection portion, connected to the upper side of the cylindrical base, the connection portion comprising at least two connection tips. The cylindrical base includes a first aperture and a second aperture provided at the lower side of the cylindrical base. Moreover, the first aperture and second aperture are each in communication with a corresponding one of the two connection tips. Further, the connecting portion has a side dimension, measured in a plane perpendicular to an axis of introducing the plug onto or into the container, that is smaller than the cylindrical base.

20 Claims, 14 Drawing Sheets

(56) References Cited

U.S. PATENT DOCUMENTS

| | | | | |
|---|---|---|---|---|
| 6,837,400 | B2 * | 1/2005 | Leoncavallo | B01L 3/10 215/308 |
| 8,240,824 | B2 * | 8/2012 | Kieser | B41J 2/17509 347/85 |
| 8,366,252 | B2 | 2/2013 | Zaba et al. | |
| 8,454,143 | B2 * | 6/2013 | Takeuchi | B41J 2/17513 347/86 |
| 9,835,810 | B2 | 12/2017 | Audouard et al. | |
| 2005/0264620 | A1 | 12/2005 | Kuester | |
| 2007/0263020 | A1 | 11/2007 | Bradford | |
| 2008/0079759 | A1 | 4/2008 | Nagashima | |
| 2016/0039216 | A1 | 2/2016 | Ribiero | |

OTHER PUBLICATIONS

Search Report issued in French Patent Application No. FR 15 56072 dated May 24, 2016.

Utility U.S. Appl. No. 15/088,178, "Configurable Connector" filed Apr. 1, 2016.

* cited by examiner

SOLVENT OR INK CONTAINER PLUG

TECHNICAL FIELD AND PRIOR ART

The invention relates to the field of printers, in particular of the ink jet type, for example of the continuous ink jet (CU) type.

It also relates to the architecture (arrangement of the Ink circuit) of such a printer, in particular to prevent situations in which some channels throughout the ink flows can be plugged upon use.

Continuous ink jet (CU) printers are well known in the field of coding and industrial labelling for various products, for example to label bar codes, the expiration date on food products, or even references or distance marks on cables or pipes directly on the production line and at a high rate. This type of printer is also found in some decorative fields where graphic printing possibilities of the technology are exploited.

These printers have several standard sub-assemblies as shown in FIG. 1.

First, a printing head 1, generally offset from the body of the printer 3, is connected thereto by a flexible umbilical 19 joining the hydraulic and electrical connections required for operating the head by providing it with flexibility which facilitates integration on the production line.

The body of the printer 3 (also called a console or cabinet) usually contains three sub-assemblies:

- an ink circuit at the lower portion of the console (zone 4'), which enables, on the one hand, ink to be provided to the head at a stable pressure and with a suitable quality, and on the other hand, the jet ink not used for printing to be accommodated;
- a controller located at the upper portion of the console (zone 5'), capable of managing the action sequencing and performing processes enabling different functions of the ink circuit and of the head to be activated,
- an interface 6 which gives the operator means for implementing the printer and for informing about its operation.

In other words, the cabinet includes 2 sub-assemblies: in the top part, the electronics, electric supply and operator interface, and in the low part, an ink circuit providing ink, of a nominal quality, under pressure to the head and the low pressure for recovering the ink not used by the head.

FIG. 2 schematically represents a printing head 1 of the CIJ printer. It includes a drop generator 60 supplied with electrically conductive ink pressurised by the ink circuit (in the zone 4').

This generator is capable of emitting at least one continuous jet through a small dimension port called a nozzle. The jet is transformed in a regular succession of identical size drops under the action of a periodical stimulation system (not represented) located upstream of the nozzle outlet. When the drops 7 are not for printing, they are directed to a gutter 62 which recovers them in order to recycle the ink not used and to bring them back in the ink circuit 4.

Devices 61 placed along the jet (charge and deflection electrodes) make it possible, by command, to electrically charge the drops and to deflect them in an electrical field Ed. Then, they are deviated from their natural ejection trajectory from the drop generator. The drops 9 for printing escape the gutter and will be deposited onto the support to be printed 8.

This description can be applied to continuous jet (CU) printers called binary printers or multi-deflected continuous jet printers. The binary CIJ printers are equipped with a head the drop generator of which has a multitude of jets, each drop of a jet can only be oriented to 2 trajectories: printing or recovery. In multi-deflected continuous jet printers, each drop of a single jet (or spaced apart from a few jets) can be deflected on various trajectories corresponding to charge commands different from one drop to the other, thus making a sweeping of the zone to be printed along a direction which is the deflection direction, the other sweeping direction of the zone to be printed is covered by a relative movement of the printing head and the support to be printed 8.

Generally, the elements are arranged such that these 2 directions are substantially perpendicular.

An ink circuit of a continuous ink jet printer first enables ink to be provided under a regulated pressure, and possibly solvent, to the drop generator of the head 1 and a low pressure to be created to recover fluids not used for printing back to the head.

It also enables consumables (ink and solvent dispensing from a pool) to be managed and the ink quality (viscosity/concentration) to be monitored and maintained.

Finally, other functions are related to the user comfort and the automatic handling of some maintenance operations in order to ensure an identical operation regardless of the conditions of use. Among these functions, there are rinsing the head with solvent (drop generator, nozzle, gutter), preventive maintenance aid such as replacing components having a limited lifetime (filters, pumps).

These different functions have very different purposes and technical requirements. They are activated and sequenced by the controller of the printer which will be all the more complex that the number and function sophistication are large.

As regards the inks used, those containing pigments, for example titanium oxide (rutile or anatase $TiO_2$), as submicron particles, are particularly interesting for their whiteness and opacity. They are called pigmented inks and are used for labelling and identifying black or dark supports.

But dense particles of pigments have a natural tendency to settle, in particular in ink supply ducts, when the ink is at rest. The consequences of this settling can be the formation, in these ducts, of solid plugs which can plug them, partly or even completely.

Further, during essential maintenance operations, the venting of connector technology, in the presence of ink, can form dry ink plugs. The same problem also relates to the cannula for connecting ink cartridges to the ink circuit: the ink is provided to the circuit from a cartridge, a consumable element the user replaces when it is empty. The connection to the ink circuit is made by a cannula which is fitted in an adapted aperture of the cartridge and which also makes up a zone for settling ink and forming solid plugs.

As a result, there can be in particular ink supply difficulties as well as an opacity loss of the labelled parts.

Generally, techniques for washing or rinsing all or part of the circuit have therefore been developed.

One technique implements the cartridges usually used. The ink cartridge is empty, depressurised. Then, it can be filled with a fluid, the solvent which comes from the solvent cartridge, after this has rinsed part of the circuit. However, the capacity of an ink or solvent cartridge is limited to less than one liter. A complete emptying of the printer, the total volume of which, including the tank(s) and the ducts, is higher than 1 l, is thus not possible. It is still less possible to make a rinsing for which the required waste volume comprises the rinsing solvent volume. Finally, during a rinsing operation, it can be necessary to change the solvent cartridge, an intervention is then necessary during these rinsing operations themselves.

Another technique implements 2 solvent cartridges, of the type usually used for printing. But, one of the solvent cartridges has to be connected to the usual connecting means of an ink cartridge, which requires the use of a specific adaptor.

Further, there arises the problem of the limited volume, already mentioned above, which may impose manual interventions during washing.

According to another technique, no cartridges are used, but the solvent and ink tanks are directly emptied, and solvent is manually added into one of these two tanks. The printer then drives the washing operations, but the above-mentioned manual intervention requires that the operator is in contact with the handled fluids, which causes the use of means for protecting face and hands.

Another technique implements some specific means, in particular including a pump (or a solenoid valve) and a recovery can, disposed for example at the ground level, and a rinsing liquid can, all of them being connected to the printer using a specific hydraulic circuit and specific electric connection means. This technique is cumbersome to implement, because it requires specific connections as well as a modification of the hydraulic circuit.

Thus, there arises the problem of finding a new method, and a new device, for performing a full washing of a CIJ type printing machine, by minimising the modifications to be made to the printing circuit usually used during printing phases. It is attempted to use the hydraulic circuit and hydraulic connections of such a printer, which are usually used during printing operations, which are made using solvent and ink cartridges.

Preferably, such a method, and such a device, enable the intervention of an operator to be minimised during operations for preparing a washing, or during the washing itself.

DISCLOSURE OF THE INVENTION

The invention first relates to a washing assistance device for the fluid circuit of an ink jet printer or a device for washing it, including:

- a support defining, between an access front face and a back face, a volume, called a free volume or an accommodating volume, being substantially parallelepiped,
- support anchoring means,
- means forming 2 fluid connections, the support anchoring means and the 2 fluid connections being disposed on or against the back face, on the opposite side to said free volume.

The support and the accommodating volume enable a first container, or can and a second washing container or can to be received.

The accommodating volume is included between, and limited by, the front face and the back face. The support includes front means which form or define the front face, and back means which form or define the back face and face the front means.

The support anchoring means make it possible to position and hold the anchored or suspended support in a cartridge compartment of an ink jet printer. This holding is ensured by the cooperation of the anchoring means with corresponding means of said compartment, for example means as cut-out or notch or groove or one or more port(s) or hole(s). The anchoring means include for example one or more axis (axes) or one or more tab(s) or one or more claw(s) or one or more hook(s).

The fluid connection means enable containers, or cans, positioned in the accommodated volume, to be connected to the solvent supply system or circuit and to the ink supply system or circuit of an ink jet printer, preferably to the inlet of these systems or circuits. Thus, it is possible to use the solvent supply circuit of an ink jet printer to pump clean solvent in the first washing can, and to send it to the ink circuit of the printer to wash it; and it is possible to use the ink supply circuit of this same ink jet printer to recover soiled solvent, after a washing by the clean solvent, and to send it to the second washing can.

The fluid connection means and/or support anchoring means are preferably positioned against the back face of the accommodating volume, this back face being then disposed between the accommodating volume and the fluid connection means and/or the anchoring means.

The invention also relates to a washing assistance device or a device for washing the fluid circuit of an ink jet printer, in particular of the type above, including:

- a support defining, between an access front face and a back face, an accommodating volume for containers;
- support anchoring means;
- fluid connection means for each of the containers to the solvent and ink supply system of an ink jet printer.

Once again, the support and the accommodating volume enable a first container, or can and a second washing container, or can to be received.

The accommodating volume is included between, and limited by, the front face and the back face. The support includes front means which form or define the front face, and back means which form or define the back face and face the front means.

The support anchoring means enable the support to be positioned, and to be held anchored or suspended, in a cartridge compartment of an ink jet printer. This holding is ensured by the cooperation of the anchoring means with corresponding means of said compartment, for example means as cut-out or notch or groove or one or more port(s) or hole(s). The anchoring means for example include one or more axis (axes) or one or more tab(s) or one or more claw(s) or one or more hook(s). The fluid connection means enable containers, or cans, positioned in the accommodating volume, to be connected to the solvent supply system or circuit and to the ink supply system or circuit of an ink jet printer, preferably to the inlet of these systems or circuits. Thus, it is possible to use the solvent supply circuit of an ink jet printer to pump clean solvent in the first washing can, and to send it to the ink circuit of the printer to wash it; and it is possible to use the ink supply circuit of this same ink jet printer to recover soiled solvent, after a washing by the clean solvent, and to send it to the second washing can.

The fluid connection means and/or support anchoring means are preferably positioned against the back face of the accommodating volume, this back face being then disposed between the accommodating volume and the fluid connection means and/or the anchoring means.

Upon preparing a washing operation, cans or containers are positioned in the accommodating volume, intended to that end, of a device according to the invention. The support is anchored in the compartment usually used for receiving the solvent and ink cartridges of the printer. The fluid connection means enable cans or containers to be connected to the usual fluid circuits of the printer.

Plugs can be provided, each plug including fluid connection tips or connectors. Preferably, such tips enable cans to be connected to the solvent or ink supply system of an ink jet printer and possibly containers to be connected to each other. Thus, the plug for a $1^{th}$ container enables, through a tip or connection, this $1^{th}$ container to be connected to the solvent supply system. Another tip or connection enables it to be connected to the $2^{nd}$ container. This $2^{nd}$ container includes a tip or connector which enables this $2^{nd}$ container to be connected to the ink supply hydraulic circuit of the printer.

The support can further include means defining side faces of the free volume, perpendicular to said front face. For example, it includes at least 2 portions of side plates. These side faces can enable containers positioned in said free volume to be blocked, in particular containers in a position for emptying the support, or preventing their movement, along at least one $1^{st}$ direction.

The support can include a base, or means forming or defining a base, perpendicular to the front face, in particular for supporting a first container and a second container; one or more container(s) are deposited onto this base. If the support includes means defining side faces, perpendicular to the front face and to said base, these enable the containers to be blocked in a position on the support, preventing at least one side movement in a plane parallel to said base.

A device according to the invention (this phrase is used, here and in the rest of the text, as a synonym of "as described above and/or in the present application") can further include means defining one or more edge(s) or rim(s) of said front face, extending parallel to, or along, the same. Said edge(s) can enable the movement to be prevented, along at least a $2^{nd}$ direction parallel to the plane of the base and perpendicular to the $1^{st}$ direction. Said edge(s) can enable the front face of the free volume, or of the accommodated volume, to be defined or delimited.

A device according to the invention can further include means defining or separating 2 compartments of the free volume. These means include a tab or a portion of a centre plate. They can be disposed between two accommodating zones of a container, and prevent at least one side movement in a plane parallel to said base. These means can include at least one rim extending along said front face.

A device according to the invention can include at least one portion of a back plate, defining said back face; this plate can be disposed substantially perpendicular to said base plate; it can prevent at least one side movement, in a plane parallel to said base, of a container positioned in said free volume.

The fluid connection means can be disposed against said portion of a back plate or, more generally, against the means forming or defining a back face.

A device according to the invention can further include at least one rim, substantially perpendicular to said back face, or to said back plate, provided with the support anchoring means.

The support anchoring means can include an axis for a rotation of the device upon positioning in an ink and solvent cartridge compartment of an ink jet printer.

Other exemplary embodiments of the anchoring means have been given above.

A device according to the invention can further include at least one window in the back face of the device. This window enables a tag of one of the containers used in the support to be read.

The invention also relates to an ink jet printer including:

a printing head;

a circuit for supplying ink and solvent to the printing head, a washing assistance device according to the invention, as described above and/or in the present application.

The invention also relates to a method for washing an ink jet printer, including a fluid circuit supplied by an ink cartridge and a solvent cartridge, disposed in the cartridge compartment of the printer, this method including:

removing the cartridges;

positioning in said cartridge compartment, a device according to the invention, as described above and/or in the present application, provided, in said volume, with a $1^{st}$ container containing solvent, and a $2^{nd}$ container, and connecting, using the fluid connection means, the $1^{st}$ container to the solvent supply system and the $2^{nd}$ container to the ink supply system of the printer;

sending solvent from the $1^{st}$ container in at least one part of the fluid circuit of the printer, and recovering this solvent, after circulating in said at least one part of the circuit, in the $2^{nd}$ container.

In such a method, the solvent of the first container can be sent into at least one part of the fluid circuit of the printer using a solvent transfer pump of this circuit.

A solvent and ink mixture, after washing the fluid circuit of the printer, can be sent to the second container using a pump, for example an ink transfer pump of this circuit.

After washing the fluid circuit of the printer, the $2^{nd}$ container can be removed from the support, and then be replaced with the $1^{st}$ container.

During the washing of the fluid circuit of the printer, a part of the liquid of the $2^{nd}$ container can be sent to the $1^{st}$ container.

The $1^{st}$ container can contain an initial solvent volume at least higher than the maximum solvent volume contained in the solvent cartridge. The $2^{nd}$ container can have a volume at least higher than the initial solvent volume contained in the $1^{st}$ container.

The invention also relates to a method for washing an ink jet printer, including a fluid circuit supplied by an ink cartridge and a solvent cartridge, this method including:

removing the cartridges;

replacing the solvent cartridge with a $1^{st}$ container, containing an initial solvent volume at least strictly higher than the maximum solvent volume contained in the solvent cartridge;

replacing the ink cartridge with a $2^{nd}$ container, having a volume at least strictly higher than the initial solvent volume contained in the $1^{st}$ container and to the maximum ink volume contained in the ink cartridge;

sending the solvent to the $1^{st}$ container, in at least one part of the fluid circuit of the printer, and recovering this solvent, after circulating in said at least one part of the circuit, in the $2^{nd}$ container.

The ink jet printer can be an ink jet printer according to the invention, in particular as described above and/or in the present application.

The $1^{st}$ container and the $2^{nd}$ container can be disposed in a washing assistance device for the fluid circuit according to the invention, in particular as described above and/or in the present application.

In such a method, the solvent of the first container can be sent into at least one part of the fluid circuit of the printer using a solvent transfer pump of this circuit.

A solvent and ink mixture, after washing the fluid circuit of the printer, can be sent to the second container using a pump, for example an ink transfer pump of this circuit.

The $1^{st}$ container and the $2^{nd}$ container can be connected using fluid connection means of the latter, to the solvent supply system and to the ink supply system of the printer.

Thus, it is possible to use the solvent supply circuit of an ink jet printer to pump clean solvent in the first washing can, and to send it into the ink circuit of the printer to wash it; and it is possible to use the ink supply circuit of the same ink jet printer to recover soiled solvent, after a washing by the clean solvent, and to send it to the second washing can. In other words, the soiled solvent circulates in the ink supply circuit in the reverse direction to the direction in which the ink circulates when it is sent to the circuits of the printer, in particular the main tank and/or the printing head.

After washing the fluid circuit of the printer, the $2^{nd}$ container can be removed, and then be replaced with the $1^{st}$ container.

During the washing of the fluid circuit of the printer, a part of the liquid of the $2^{nd}$ container can be sent to the $1^{st}$ container.

The $1^{st}$ container can contain an initial solvent volume at least higher than the maximum solvent volume contained in the solvent cartridge. The $2^{nd}$ container can have a volume at least higher than the initial solvent volume contained in the $1^{st}$ container.

The invention also relates, possibly in combination with a washing assistance device for the fluid circuit according to the invention, a container plug including:

a cylindrical base, a connection portion in an upper part, which includes at least 2 connection tips as well as, possibly, at least one aperture, for example for putting to the atmospheric pressure (this aperture, when present, can be sealed by a seal);

on the side of the lower part of the base, or on the side of the plug to be facing the inside of a container closed by the plug, at least 2 corresponding apertures, which communicate with said tips; and, possibly, an aperture which communicates with the possible aperture in the connection portion.

Such a plug can be made independently of a washing assistance device of the fluid circuit according to the invention.

In such a plug, said base can be introduced, for example by screwing, on or in the aperture of a container to seal it.

Two such plugs can be associated, for example to equip containers used with a device according to the invention, in particular that described above and/or in the present application. Ducts can then connect each of the plugs to the fluid connections.

A duct can possibly connect the plugs to each other, to form an overflow discharging circuit of one of the containers on which the plugs are mounted.

The invention thus also relates to an assembly of 2 plugs, each of which being according to the invention, this assembly further including a duct for connecting a connection tip of one of the plugs with a connecting tip of the other plug.

The invention also relates to one (or 2) container(s) intended to contain—or containing—solvent or ink of an ink jet printer, with which is further associated a closing plug and a plug according to the invention, or a closing plug and a plug according to the invention being associated with each container; the or each closing plug can be replaced with a plug according to the invention, for example during a use as set forth in the present application.

The ink jet printer implemented in a method according to the invention, in particular as described above and/or in the present application, or in which a device according to the invention, in particular as described above and/or in the present application, can be used, can be a continuous ink jet (CU) printer, in particular of the binary type, or a multi-deflected continuous jet printer.

DETAILED DISCLOSURE OF ONE EMBODIMENT

Figure 1:
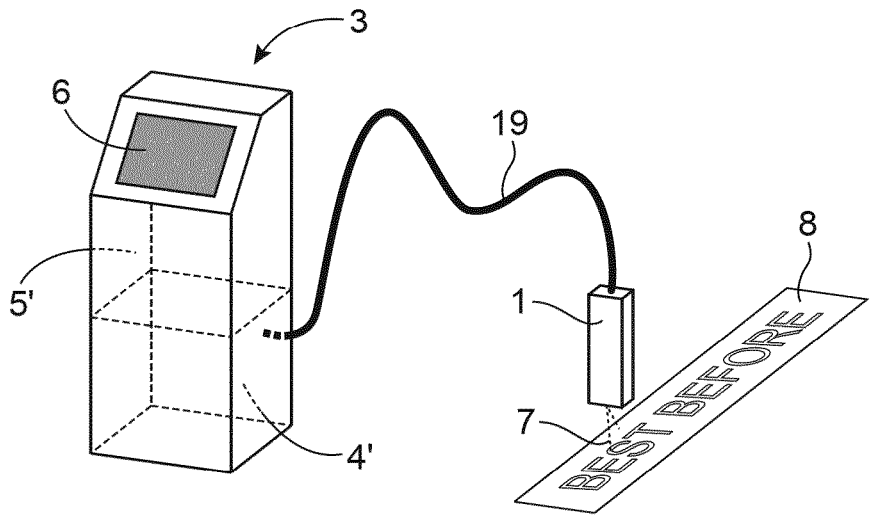
FIG. 1 represents a known structure of a printer.

An exemplary device according to the invention is illustrated in FIGS. 3, 4 and 5A-5B.

It includes a support 80 enabling two cans (or containers) 82, 84, one with solvent, the other initially empty, to be accommodated. It is represented, in FIG. 3, as including a single can 84, a second can 82 not yet being installed (see FIG. 9A). In the embodiment illustrated, this support includes a base, for example as a support plate 86, substantially planar or defining a plane, called a lower plane. This plate can be apertured or open, for example leaving only a frame in which the cans or containers will possibly be positioned and supported. Alternatively (not represented), the base can be defined by, or include, several bars or small bars disposed at least partly parallel to each other or at least partly in a cross or crossing each other or one or more grid(s), forming a support zone on which the cans or containers will possibly be positioned and supported. The means that define the base (the plate 86 in the example illustrated), can define the base of a parallelepiped, which extends up to the upper part of the device, here defined by the means 88 (described below). The support defines a volume 80*a*, called an accommodating volume, being substantially parallelepiped, between, on the one hand, means forming a front face 80*c* and means forming a back face 80*d* and, on the other hand, between the means forming the base (in the example represented: the support plate 86) and the upper part of the support.

The means forming the front face or delimiting this front face can for example include a rim (see description below). Alternatively (not represented), these means can include a front plate, which can be apertured or open, or be defined by, or include, several bars or small bars disposed at least partly parallel to each other or at least partly in a cross or crossing each other or these means can include one or more grid(s).

The means forming the back face or delimiting this back face can for example include a back plate, which can be apertured or open, or be defined by, or include, several bars or small bars disposed at least partly in parallel to each other or at least partly as a cross or crossing each other or these means can include one or more grid(s).

Each of the cans 82, 84 can have a volume between 1 l or 1.5 l and 5 l or 10 l, for example 3 l, sufficient to afford a complete emptying of the printer without having to change the can. The total accommodating volume 80*a* can be between 2 and 20 l.

Figure 4:
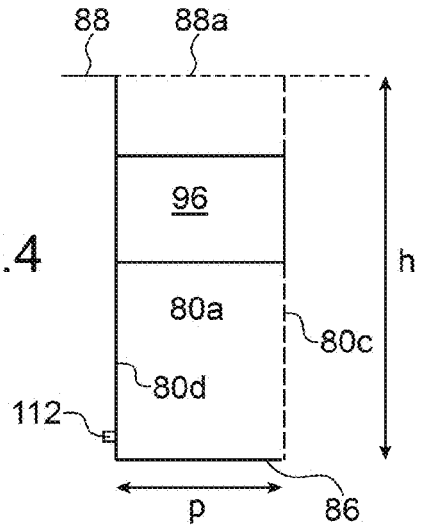
FIG. 4 is a side view of a device according to the present invention.

FIG. 4 represents a side view of the support, the device being in a position of use. The volume 80 is delimited therein, on the one hand by the lower plate 86, by the front face 80*c* (which is forwardly to a user which faces the device), by the back face 80*d* (which is backwardly with respect to a user which faces the device), and by an upper plane 88*a*, parallel to the lower plate 86 and substantially as an extension of the means 88.

There is for example:

100 mm<p<300 mm, and/or 200 mm<h<500 mm and/or 150 mm<l<600 mm.

The means 88 enable, during an emptying or a washing of all or part of the fluid circuit of the printer, this support to be held in place in the compartment usually used to position the solvent and ink cartridges, after the latter have been removed.

Figure 5B:
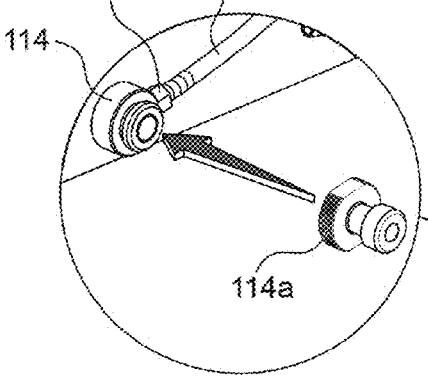
FIGS. 5A, 5B represent other aspects of a device according to the present invention.
Figure 5A:
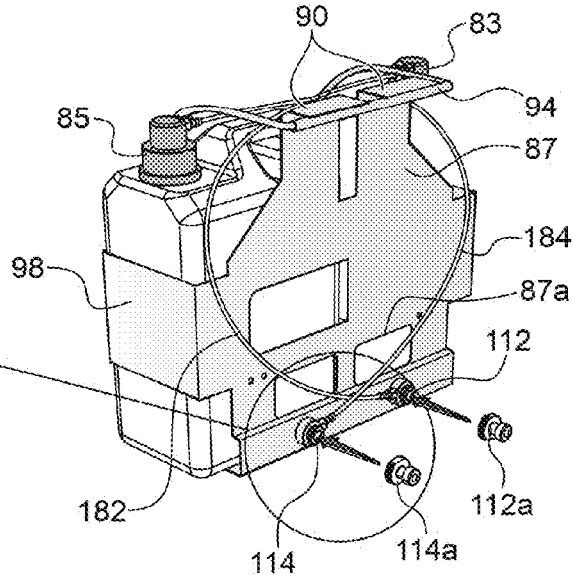

In the embodiment illustrated, these means include at least one rim 90 (two rims are represented in FIGS. 4 and 5A), substantially parallel to the support plate or to the plane it defines. A free end of this rim can include or form an axis or hinge 94 intended, as illustrated in FIGS. 9E and 9F, to be inserted in apertures enabling solvent and ink cartridges to be positioned.

According to one embodiment, these means 88 are made as an extension of a back support plate 87, the rim 90 extending substantially perpendicularly to this plate 87.

The support anchoring means can take other shapes, not represented here. The anchoring means include for example one or more axis (axes) or one or more tab(s) or one or more claw(s) or one or more hook(s). They enable the hooked or suspended support to be positioned and held in a cartridge compartment of an ink jet printer. This holding is ensured by the cooperation of the anchoring means with corresponding means of said compartment, for example means as cut-out or notch or groove or one or more port(s) or hole(s).

The means 88, as well as the fluid connection elements 112, 114, which are described later, are disposed on or against the back face 80*d* of the device, but on the opposite side to the compartment or to the volume 80*a*. Thus, when the device is used, this can be simply applied against the wall of the cartridge compartment of a printer, the containers or cans having been brought into this device through its front face 80*c*.

Means can be provided to avoid movements of the cans 82, 84, in a plane parallel to the plate 86, when the same are positioned on the support. To that end, means forming side faces can be provided; these are for example side plates or portions of side plates 96, 98 disposed substantially perpendicular to the plate 86 or to the plane it defines. Each plate can be apertured or open. Alternatively (not represented), the means each forming side faces can for example include a rim or include several bars or small bars disposed at least partly parallel to each other or at least partly as a cross or crossing each other, or even including one or more grid(s).

A beam or centre plate 100 can also be disposed substantially perpendicular to the plate or to the plane it defines, to separate the accommodating zones of both cans. The plate can be apertured or open. More generally, means for separating the accommodating volume into 2 accommodating zones can include a rim or include several bars or small bars disposed at least partly parallel to each other or at least partly as a cross or crossing each other, or even include one or more grid(s). These plates 96, 98, 100 or portions of side and/or centre plate, enable can movements to be prevented along a $1^{st}$ direction parallel to the plate.

The plate portions 96, 98, 100 can have rims 196, 198, 102, 102' which enable the can movements to be prevented along a $2^{nd}$ direction, perpendicular to the $1^{st}$ direction but still parallel to the plate.

The support plate 86 can in turn be provided with a rim 86' which blocks the cans during a possible forward movement. The front means delimitating the front face then include this rim. The use of a simple rim 86' enables the cans disposed in the support to be kept visible, and thus to make it possible to visually check the liquid level they contain.

On top of the device, the volume 80*a* is open to afford a ready introduction, through the top, of the cans or containers.

But it is also preferable to prevent can movements in a plane perpendicular to the plate. To that end, blocking or latching means 200, 200' enable cans in a position on the plate to be blocked. These means include an element which is movable with respect to the support, for example arch-shaped, which is to be positioned above the cans after they are installed on the plate 86 and which can be possibly blocked or latched by means 200', for example a front rim which projects forwardly with respect to the plane of the rim 86'. The arch can have some flexibility which enables, upon closing, to bring a part thereof in a position behind the means 200'.

According to one embodiment, this element 200 is rotatably movable about a hinge, preferably the same as the hinge 94. These means 200 include a first part 201 and a second part 202, for being positioned, respectively, above each of the cans 82, 84. These parts can also form means for gripping the entire device, when the same is provided with its cans. They are connected by a third part 203, which is to be positioned, when these means 200 are in a closing or latching position, substantially in parallel along the bottom of the cans 82, 84 (see FIG. 9D).

In the embodiment illustrated, all the side 96, 98 and centre 100 plates, the rim 90 as well as the blocking means 200 are attached to the back plate 87, disposed perpendicular, or substantially perpendicular, to the support plate 86.

Figure 5C:
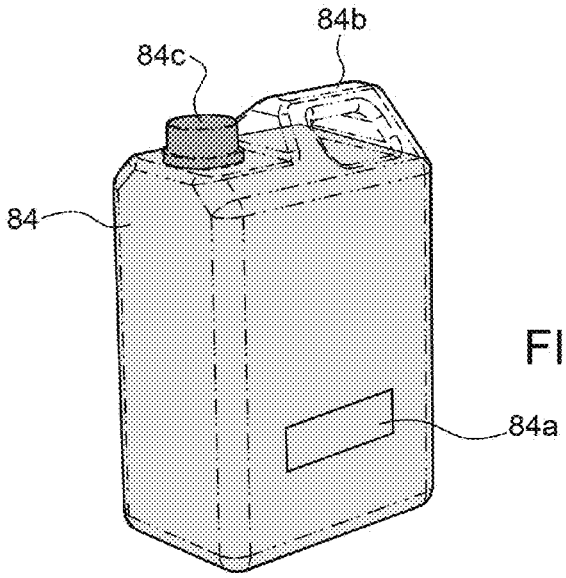
FIG. 5C represents a container, or can, than can be used in combination with a device according to the present invention.

This back plate can be provided with at least one window (here 2 windows) 87*a*, 87*b*, which makes it possible to read a "tag" which can equip either and/or both cans. In FIG. 5C, is represented a can 84 provided with such a "tag" (or circuit) 84*a*, for example made as a processor or microprocessor.

This circuit 84*a* is for example applied against a wall of the can, outside the same. It can further include communication means, for example a RFID type interface, which will afford to talk with the controller 3 of the printer, in particular to provide it with one or more data which could be interpreted as reflecting the presence of the can and/or (in the case of the solvent can) one or more data related to the liquid it contains.

In turn, the controller 3 is also provided with communication means, for example a RFID type interface, which will afford to receive the data transmitted by the cartridge tag.

Alternatively, the communication between the printer body and the tag of a can be of the contact type. In this case, contacts are provided, on the one hand on the can, on the other hand on the printer, to ensure data transmission between the can tag and the printer. Sending a RFID signal, from the tag to the controller, or reading, by the same, the presence of the tag contacts, enables the presence of the can to be detected. This check can be periodically made.

Regardless of whether it is provided with a "tag 84", the can 84 can be provided, preferably in its upper part, with a handle 84*b* and a plug 84*c*. The can 84 (or 82) also defines a substantially parallelepiped volume. The can 82, which contains clean solvent at the start of a washing operation can have a volume lower than that of the can 84 intended to recover the soiled (or dirty) solvent, as washing operations proceed.

The support also includes means 112, 112*a*, 114, 114*a* for connecting to the fluid circuit of the printer. Through these means, portions of ducts 182, 184 will afford to connect:

- on the one hand an outlet of the solvent can 82 to the solvent supply circuit of the printer,
- on the other hand, an inlet of the recovery can 84 to the ink supply circuit of the printer.

These means for connecting to the fluid circuit can be made or disposed against a portion of the back plate 87, in its lower part, in the proximity of the zone in which it is joined to the support plate 86, for example within 1 cm or 5 cm from the plane defined by the plate 86. Each of these connecting means is positioned to face the means 112*c*, 114*c* for connecting to the ink or solvent circuit, when the support is positioned in the cartridge compartment of a printer (see FIGS. 8A and 9E).

To that end, the support can be provided with connecting means 112, 114, of a substantially cylindrical shape, making it possible to receive sidewise, by connecting means 114*b*, disposed sidewise with respect to the substantially cylindrical shape, a duct or tube 182, 184 which is connected to one of the cans. Each of the connecting means 112, 114 can be identical to the mouth or cap of a solvent 40 or ink 30 cartridge.

Each of these means 112, 114 can be connected to the corresponding means 112*c*, 114*c* (FIG. 8A) for connecting the solvent and ink supply circuit to which the solvent 40 or ink 30 cartridges are usually connected. Or, to each of these means 112, 114, can be applied a converter element 112*a*, 114*a* which will enable the corresponding means 112, 114 to be connected to the means 112*c*, 114*c* (FIG. 8A) for connecting the solvent and ink supply circuit to which the solvent 40 or ink 30 cartridges are usually connected. These means 112, 114, 112*a*, 114*a* will thus enable the pumping means usually used in the printer to be used, in order to pump, respectively, solvent or ink from the corresponding cartridges used during printing operations; these cartridges are removed to be replaced with the support according to the invention, with its cans 82, 84, during washing operations.

Plugs 85, 83, for example of the type illustrated in FIGS. 6A-6B and 7A-7B, which can equip the cans or containers implemented according to the invention, and regardless of the embodiment of the invention, are also described.

Each of them includes a preferably circular base 831, 851 which can be introduced, for example through screwing, on or in the aperture of one of the cans to seal it.

The base is surmounted by a connecting portion 832, 852 in its upper part (for being outside or above the can when the plug is in a position of use on the same), which includes at least 2 connection tips or connectors 833, 834 and 853, 854, for example "hose barb" connectors (but other shapes can be contemplated), as well as, possibly, an aperture 835, 855 for putting to atmospheric pressure the inside of the can (this aperture 835, 855, even if present, can be closed or sealed). Each of the connectors enables a duct to be held or connected, which will enable on the one hand the corresponding plug to be connected, and on the other hand, either the solvent or ink circuit of the printer, or the other plug to be connected, as explained above.

Figure 6A:
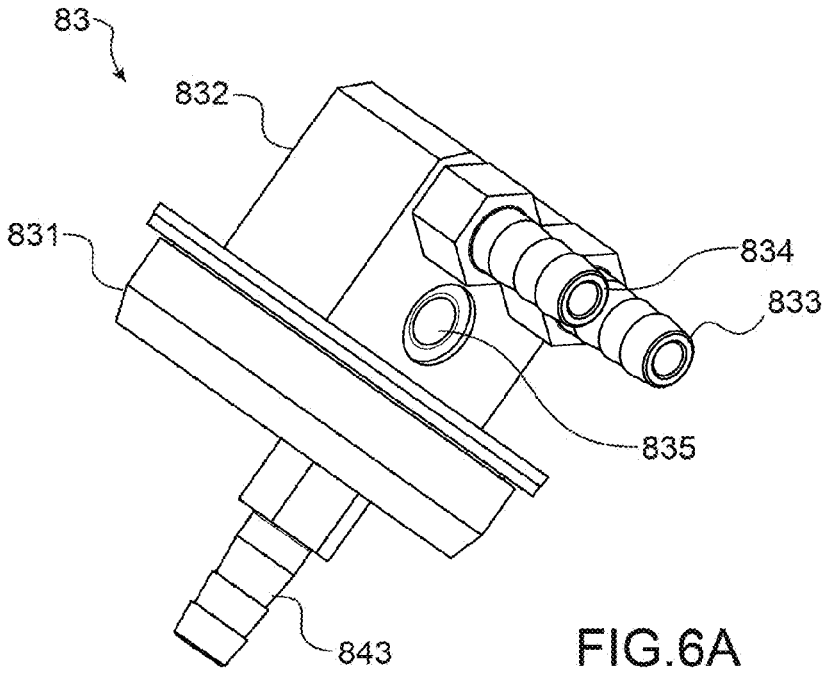
FIGS. 6A-7B represent plugs that can be used in combination with a device according to the present invention.
Figure 6B:
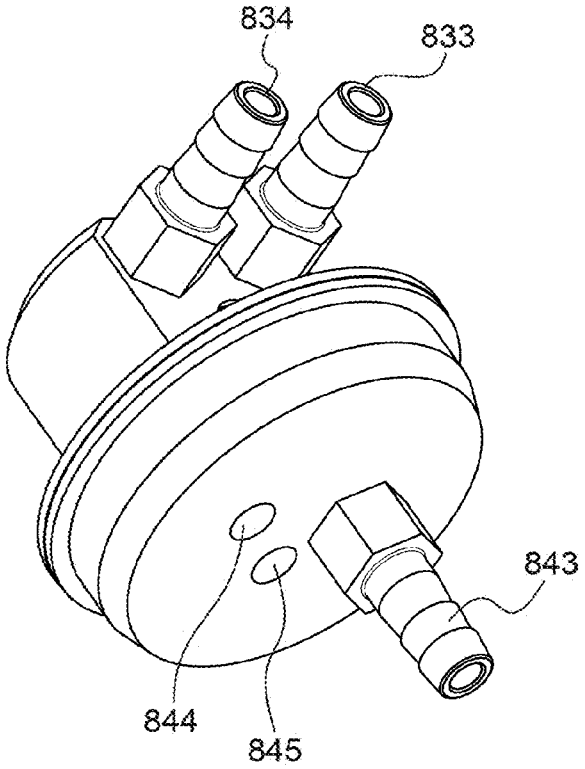
Figure 7A:
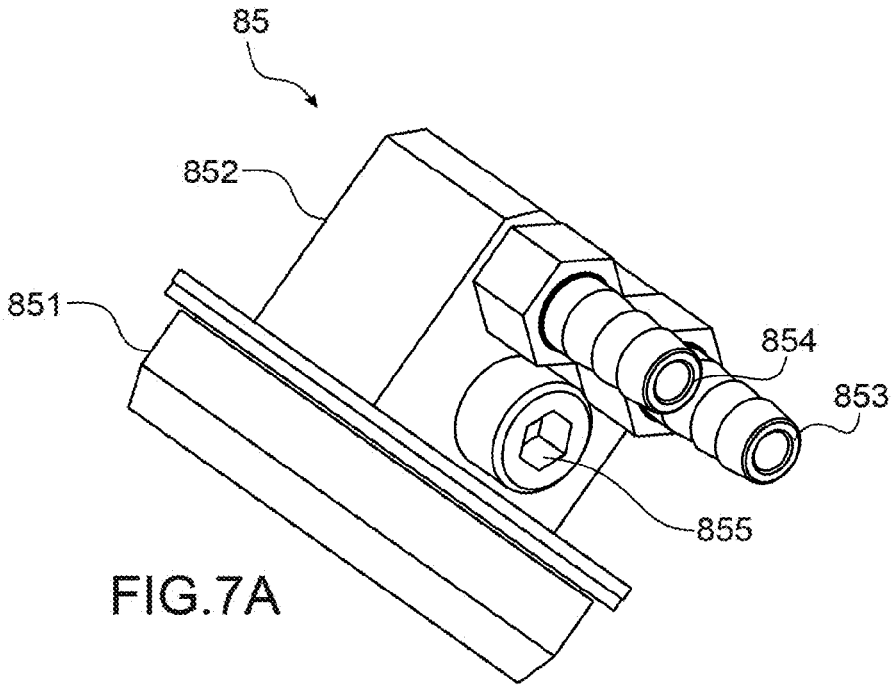
Figure 7B:
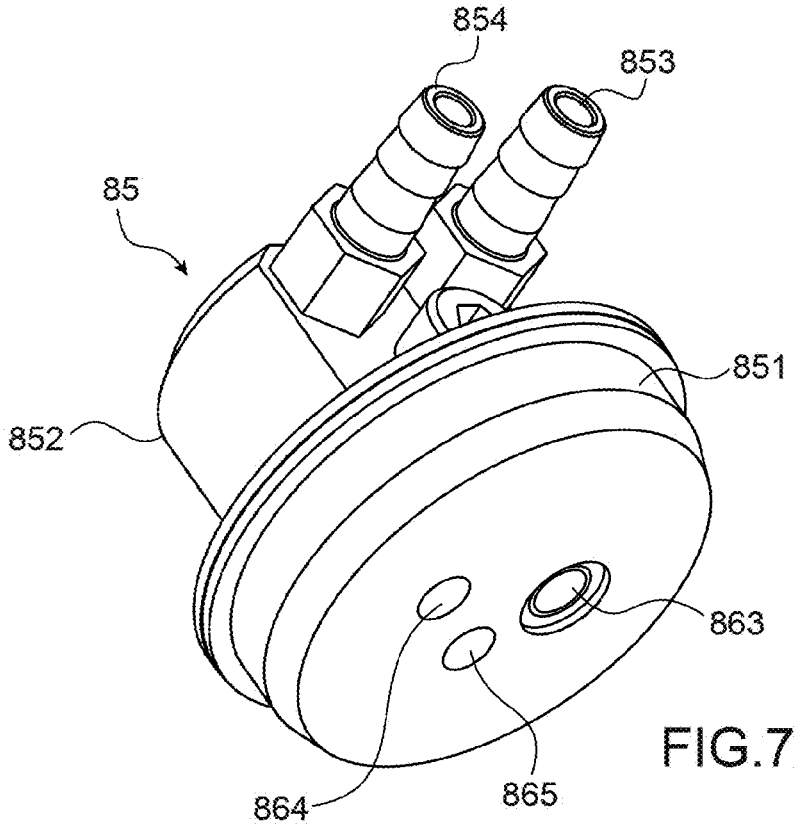

The connecting portion can be of a diameter or side dimension lower than that of the base, these diameter(s) or dimension(s) being measured in a plane perpendicular to an axis of introducing the plug on or in a container. The connecting portion can be positioned or can rest on an upper surface, possibly planar (as can be seen in FIGS. 6A and 7A), of the base.

On the side to be oriented inwardly of the can, are located:

- for the plug 83: a connector 843 (which communicates with the connector 833), and an aperture 844 (which communicates with the connector 834); and, possibly, an aperture 845 (which communicates with the aperture 835 if present; but the latter, even if present, can be closed or sealed);
- for the plug 85: corresponding apertures 864 (which communicates with the connector 854), and 863 (which communicates with the connector 853), and possibly an aperture 865 (which communicates with the aperture 855; but the latter, even if present, can be closed or sealed, a possible putting to atmospheric pressure being for example made by the other plug when both plugs communicate with each other via the duct connected to the connectors 854 and 833).

Each external connector or aperture 833-834, 853-855 is connected to the corresponding internal connector or to the corresponding internal aperture by a duct internal to the plug or to the connecting portion and not visible in the figures.

In the case of the plug 83, the connector 843 enables a duct 188 to be mounted (see FIG. 9B) which will make it possible to reach, in the lower part of the can 82, solvent which would be in the bottom thereof.

Figure 8A:
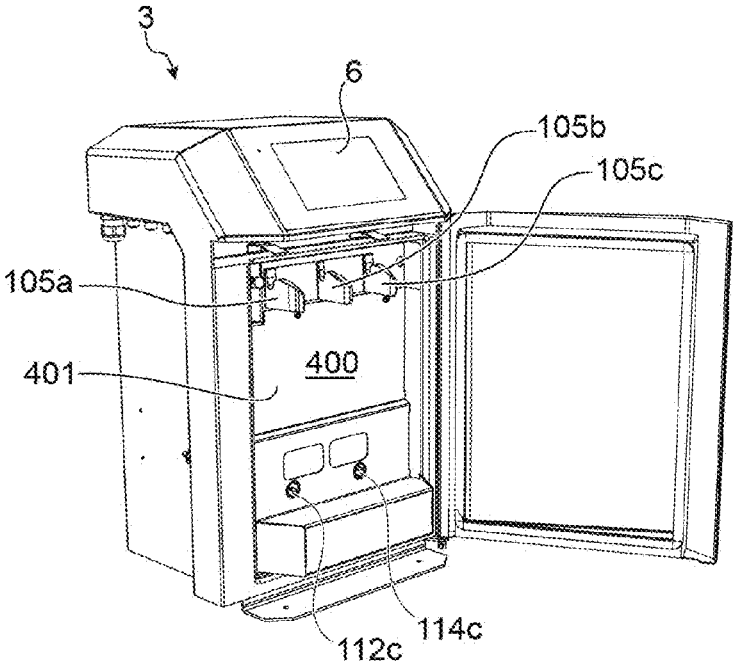
FIGS. 8A, 8B and 8D represent various aspects of a compartment for the cartridges of a CIJ type printer

A compartment 400 for ink 30 and solvent 40 cartridges of a CIJ type printer is schematically represented in FIG. 8A. Held against a back wall 401 of this compartment, means 105*a*, 105*b*, 105*c* will enable the cartridges to be positioned and held. Means 112*c*, 114*c* (for example each as a cannula) enable each cartridge to be connected to the fluid circuit of the printer. These means are disposed in the lower or bottom part of the compartment 400.

Figure 8B:
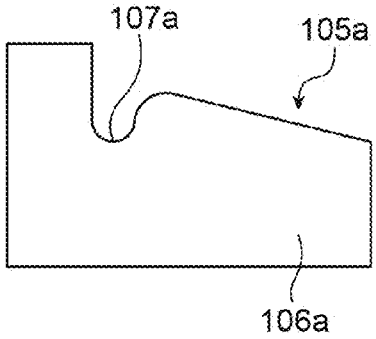

An exemplary embodiment of the means 105*a* (the means 105*b, c* are identical to 105*a*) is represented in FIG. 8B: they include a plate shaped piece 106*a* (respectively 106*b, c*), with a substantially perpendicular shape and provided with a cut-out or notch 107*a* (respectively 107*b, c*).

Figure 8C:
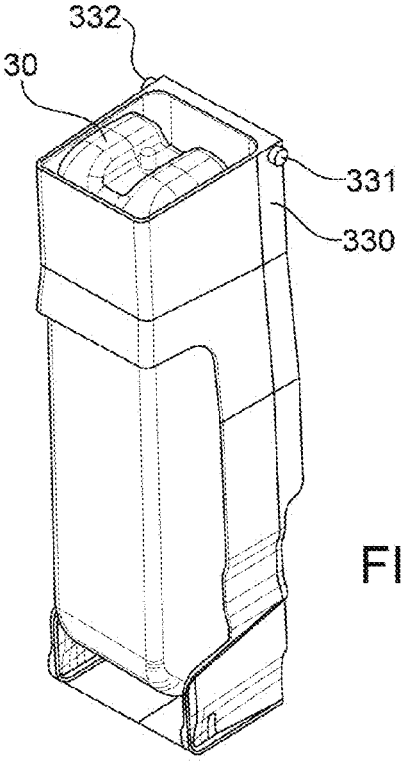
FIG. 8C represents a cartridge in its cartridge holder.

An exemplary ink cartridge 30 is illustrated in FIG. 8C, inserted in its case (or cartridge holder) 330 provided with side pins 331, 332 in its upper part, each for being positioned in one of the notches 107*a-c*. A solvent cartridge 40 is also intended to be inserted in its case 340 of the same type. The bottom of the back part of each cartridge (not visible in the figures) is provided with a mouth for a hydraulic connection to the ink (or solvent) circuit via the means 112*c*, 114*c*. The cartridge holder is configured for the passage of this mouth in view of this connection. It is also configured to enable a possible tag disposed against the wall of the cartridge which is oriented to the wall 401 of the compartment 400 to be read.

Figure 8D:
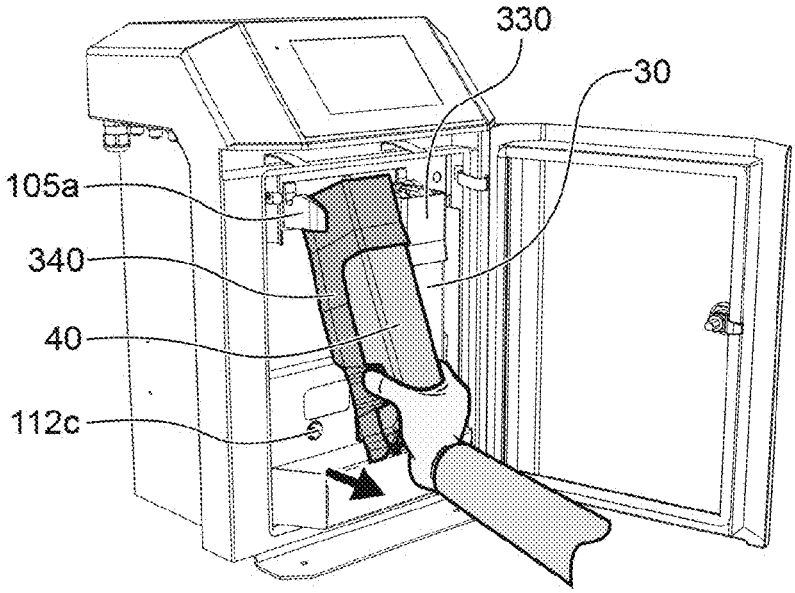

FIG. 8D represents 2 cartridges 30, 40, each in a cartridge holder 330, 340, in the compartment 400, the cartridge 40 being currently installed. The means 105*a, b, c* are disposed such that 2 of them are disposed on either side of each cartridge holder, the side pins 331, respectively 332 of which have just been inserted and rest in the corresponding notches 107*a* (respectively b). The hydraulic connecting mouth of each cartridge then communicates with the ink (or solvent) circuit through the means 112*c*, 114*c*.

A use of the support described above can be the following one.

Figure 9A:
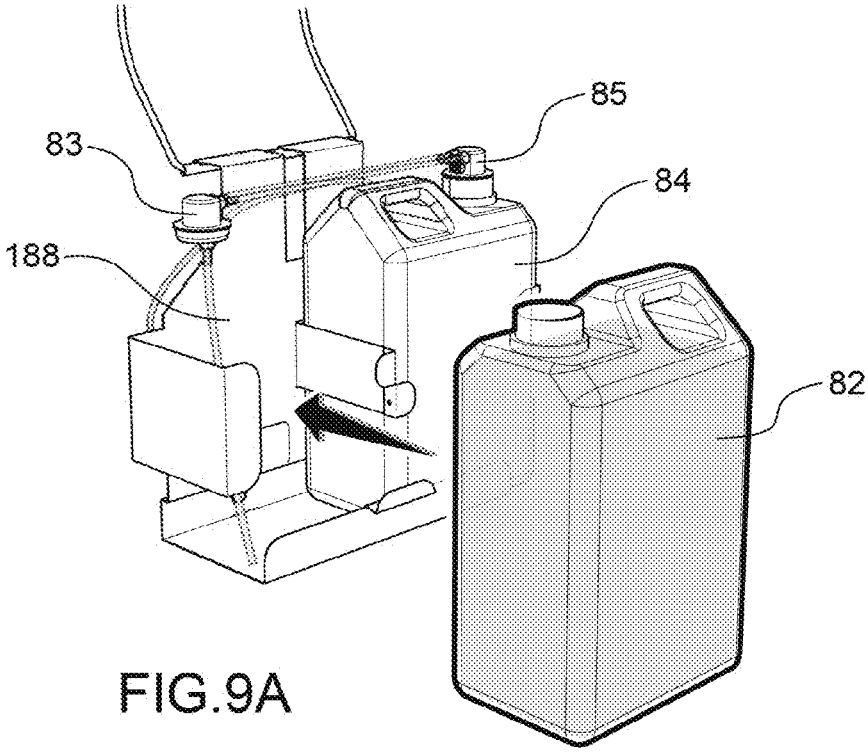
FIGS. 9A-10B represent steps for implementing an exemplary washing method according to the present invention.

Two cans 82, 84 are placed on the support, one containing clean solvent, the other being empty (FIG. 9A).

The cans can be provided with plugs 83, 85, for example of the type illustrated in FIGS. 6A-6B and 7A-7B (FIG. 9B), the plugs which close these cans when they are not used for washing a printer (such as the plug 84*c*, FIG. 5C) being removed.

The plug 85 is intended to be positioned on the initially empty can 84, which will be filled during emptying or washing. The aperture 863, connected to the tip 853, enables a possible liquid overflow to be discharged outwardly (an overflow which can result from an incident), in case where this can is filled beyond its maximum capacity.

The tip 853 is itself connected to the tip 833 of the plug 83, via a duct 186, in order to transfer the possible overflow into the other can.

The plug 83 is intended to be positioned on the can 82 initially containing solvent, which will be emptied upon emptying or washing.

Figure 9B:
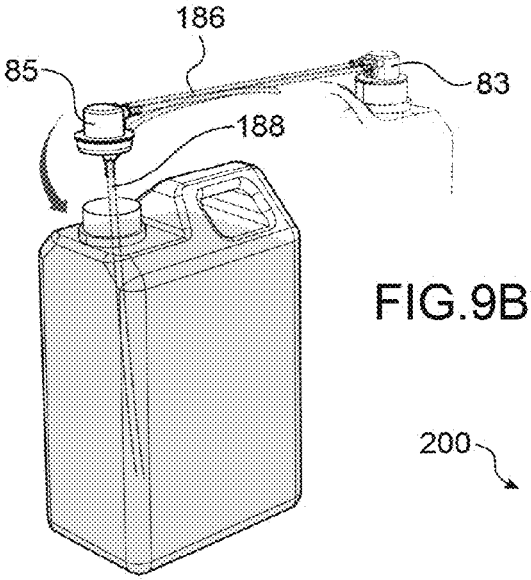

When they are attached to their respective cans, both plugs are connected through the duct 186 as illustrated in FIG. 9B. As indicated above, this duct enables the possible liquid overflow of the can 84, initially empty, to be brought to the solvent can 82, which is emptied little by little during washing operations. The possible overflow happens at the end of washing, it thus does not risk to be mixed with a significant amount of clean solvent still contained in the solvent can 82.

The fluid connections to the means 112, 114 are then set. The duct 182 connects the can 82 to the means 112 by a hydraulic connection to the solvent circuit (FIGS. 4, 5A). The duct 184 connects the can 84 to the means 114, for a hydraulic connection to the ink circuit (FIG. 5A).

Figure 9C:
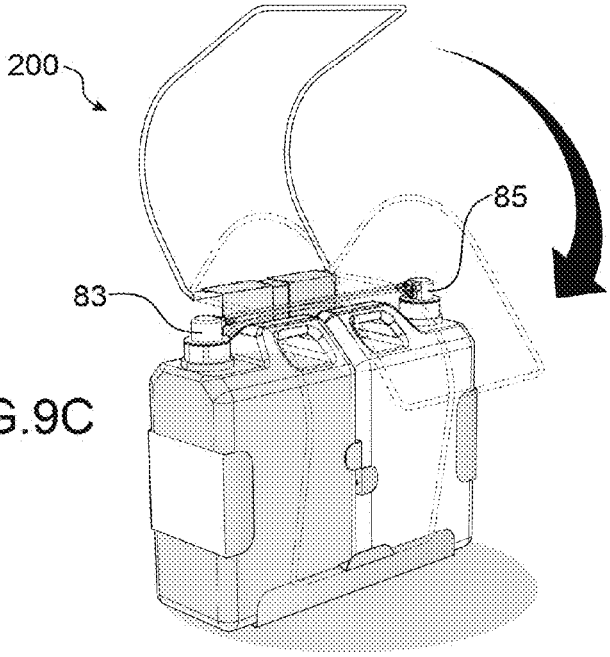
Figure 9D:
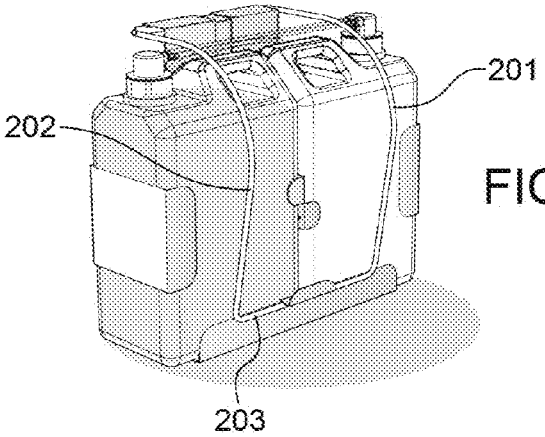
Figure 9E:
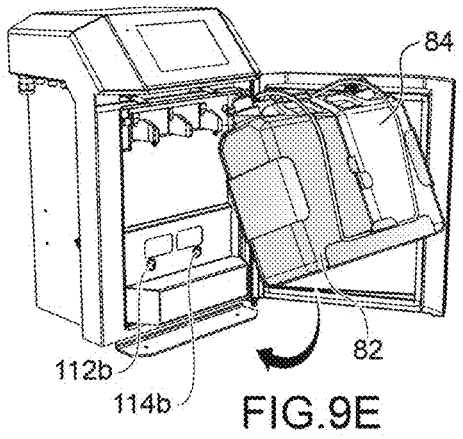
Figure 9F:
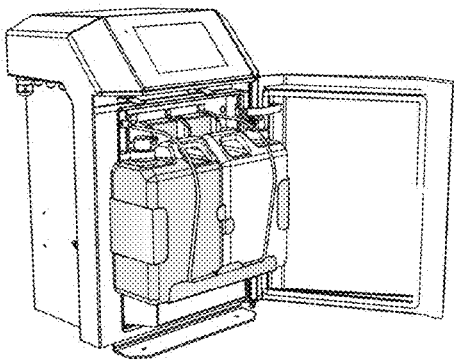

The movable arc 200 enables the cans 82, 84 to be blocked along a vertical direction (FIGS. 9C and 9D).

The cartridges usually used are removed from the compartment 400 it contains (FIG. 8D).

The support provided with its connected cans as explained above is positioned in this compartment 400 (FIG. 9E), its means 88 make it possible, in cooperation with the means 105*a-c* (and more specifically the axis 94 with the means 107*a-c*) to be held in place during an emptying or washing of all or part of the fluid circuit of the printer (FIG. 9F), the door of the compartment 400 being possibly held open if the overall space of the whole is higher than that of the cartridges. The means 112, 112*a*, 114, 114*a* will be positioned against the means 112*c*, 114*c* in the same manner as the cartridges when the same are in a position of use in the machine.

The whole including the support and the cans 82, 84 can thus be placed in the cartridge compartment, using advantageously the means usually used for positioning the cartridges. Therefore, there is a simple exchange of the cartridges with the support provided with its 2 cans. The fluid connections of the support are positioned in front of the accesses to the fluid circuit, usually utilised for connecting the solvent and ink cartridges thereto. The intervention of an operator is thus minimal.

The fluid connections being set make it possible to connect:

- on the one hand, an outlet of the solvent can 82 to the solvent supply circuit of the printer,
- on the other hand, an inlet of the can 84 to the ink supply circuit of the printer.

In view of an emptying or washing operation, the cartridges 30, 40 are removed from the compartment, and a support such as the support 80 is positioned, its attachment means then cooperating with the means usually used for attaching the cartridges, its fluid connections then cooperating with the fluid connections of the compartment, usually used to take respectively solvent and ink out of the cartridges 40, 30.

Washing operations can then occur, solvent being sent, from the can 82, into some parts of the fluid circuit, and then recovered in the can 84. The pumping means, respectively of the solvent supply circuit and the ink supply circuit (or for pressurising the ink for sending to a printing head) are respectively used to pump solvent from the can 82 and to send the soiled fluid, a mixture of solvent and ink, to the can 84.

The volume stored in the can 82 and the volume of the can 84 are sufficient to wash the entire circuit. In particular, the volume of solvent initially contained in the can 82 can be lower than the total volume of the can 84; for example if the latter has a maximum capacity of 3 l, in order to wash the entire circuit, it can be only filled with 1.5 l of solvent, which will be sufficient. On the other hand, when the same can is used as a soiled solvent can, its maximum capacity of 3 l will be useful for the entire circuit (which also contains ink, in its hydraulic circuit and in its main tank). The volume of solvent stored in the can 82 at the beginning of a washing is higher than that stored in a cartridge 40 of solvent not yet used, this volume being about 600 $cm^3$ or 800 $cm^3$ in any case lower than 1 l, whereas the solvent can 82 contains, at the beginning of the washing operations, at least 1.5 l of solvent.

Prior to or during the washing, the ink which remains in a tank and/or in any other part of the circuit can have been pumped and sent to the can 84, which acts as a receptacle for the circuit waste.

The washing operations are controlled by the controller (or control means) 3 of the entire printer. Instructions, to activate the pumping means, in particular of the solvent supply circuit and the ink supply circuit, and the possible other hydraulic components of the printer (pumps, valves) are sent and controlled by these means 3. In particular, these are the instructions that will make it possible to circulate solvent, from the can 82, towards various parts of the hydraulic or fluid circuit of the printer and will make it possible to send soiled fluid, from various parts of the hydraulic or fluid circuit of the printer to the can 84.

The control means 3 include for example a processor or a microprocessor, programmed to implement a washing or emptying method. It also ensures storing data, for example, ink and/or solvent level measurement data, and their possible processing. The controller is also programmed to manage operations other than those of washing in particular, after washing, the printing operations.

Figure 10A:
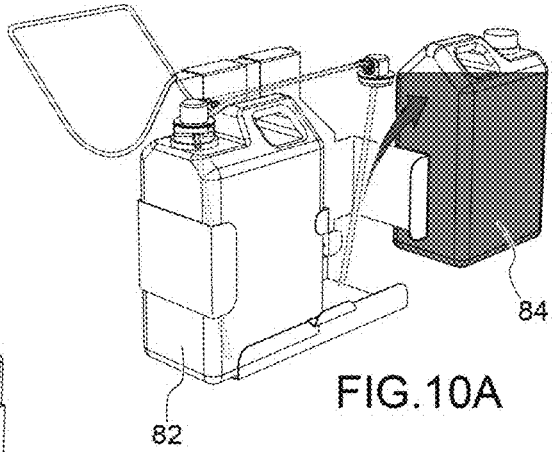
Figure 10B:
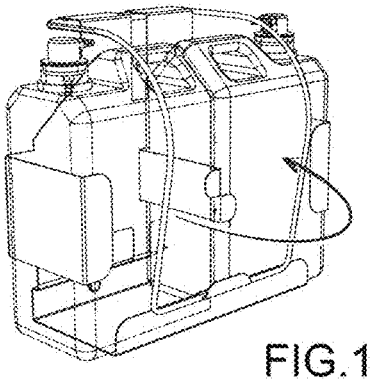

When the washing operations are ended, the support can be removed from the compartment, and ink and solvent cartridges 30, 40 can be reinstalled. The can 84 have then collected the soiled solvent which has been used to wash the elements of the circuit. After deblocking the arch 200, it can be removed (FIG. 10A). If the solvent can 82 is empty or nearly empty, it can take the place of the can 84 (FIG. 10B) for a future washing operation, for which only one new can, filled with solvent, will consequently be necessary.

Figure 11:
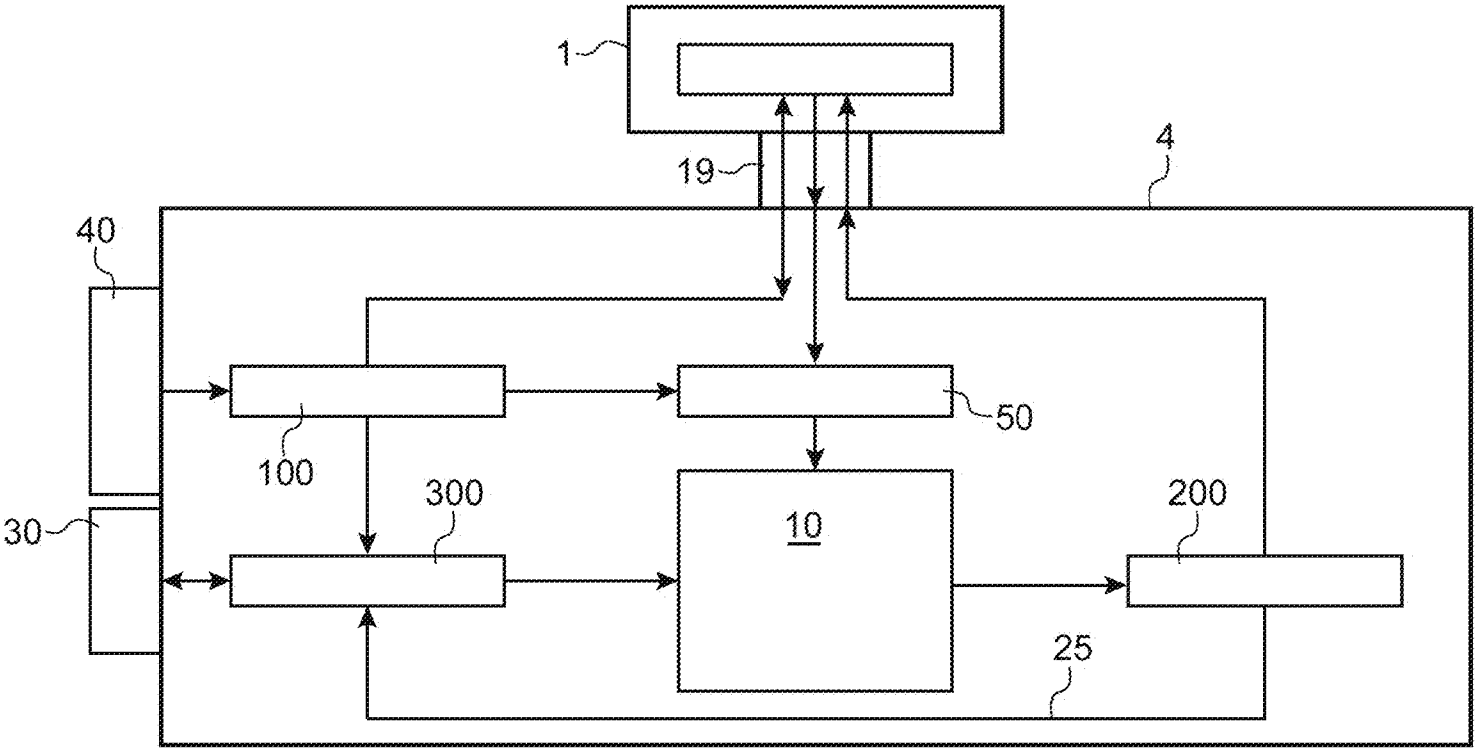
FIG. 11 represents an exemplary structure of a fluid circuit.

An example of an architecture of the fluid circuit of a printer to which the invention can be applied, is illustrated in FIG. 11. Identical references to those previously already used designate identical or corresponding elements. In particular, there are the flexible umbilical 19, which gathers the hydraulic and electrical connections and the printing head 1, to which the printer architecture described below can be connected.

In this FIG. 11, it can be seen that the fluid circuit 4 of the printer includes a plurality of means 10, 50, 100, 200, 300, each associated with a specific functionality.

With this circuit 4 are associated a removable ink cartridge 30 and a solvent cartridge 40, removable as well.

Reference 10 designates the main tank, which enables a solvent and ink mixture to be accommodated.

Reference 100 designates all the means which make it possible to take, and possibly to store, solvent from a solvent cartridge 40 and to provide the solvent thus taken to other parts of the printer, regardless of whether the aim is to supply the main tank 10 with solvent, or to wash or maintain one or more of the other parts of the machine.

Reference 300 designates all the means that make it possible to take ink from an ink cartridge 30 and to provide the ink thus taken to supply the main tank 10. As can be seen in this figure, according to the embodiment set forth here, sending solvent to the main tank 10 and from the means 100 is made through these same means 300.

At the outlet of the tank 10, an assembly of means, overall designated by reference 200, enables the ink taken from the main tank to be pressurised, and to be sent to the printing head 1. According to one embodiment, illustrated here by the arrow 25, it is also possible, through these means 200, to send ink to the means 300, and then again to the tank 10, which affords a recirculation of ink inside the circuit. This circuit 200 also makes it possible to empty the tank in the cartridge 30 as well as to wash the connector technology of the cartridge 30 (in the case of the embodiment of FIG. 6, by changing the position of the valve 37).

The system represented in this figure also includes means 50 for recovering the fluids (ink and/or solvent) which comes back from the printing head, more exactly from the gutter 62 of the printing head or the head rinsing circuit. These means 50 are thereby disposed downstream of the umbilical 19 (with respect to the circulation direction of the fluids which come back from the printing head).

As can be seen in FIG. 11, the means 100 can enable solvent to be directly sent to these means 50, without passing neither through the umbilical 19 nor through the printing head 1 nor through the recover gutter 62.

The means 100 can include at least 3 parallel solvent supplies, one to the head 1, the $2^{nd}$ to the means 50 and the $3^{rd}$ to the means 300.

Each of the means described above is provided with means, such as valves, preferably solenoid valves, which enable the fluid concerned to be oriented to the destination chosen. Thus, from the means 100, solvent can be sent exclusively to the head 1, or to the means 50 or to the means 300.

Figure 12:
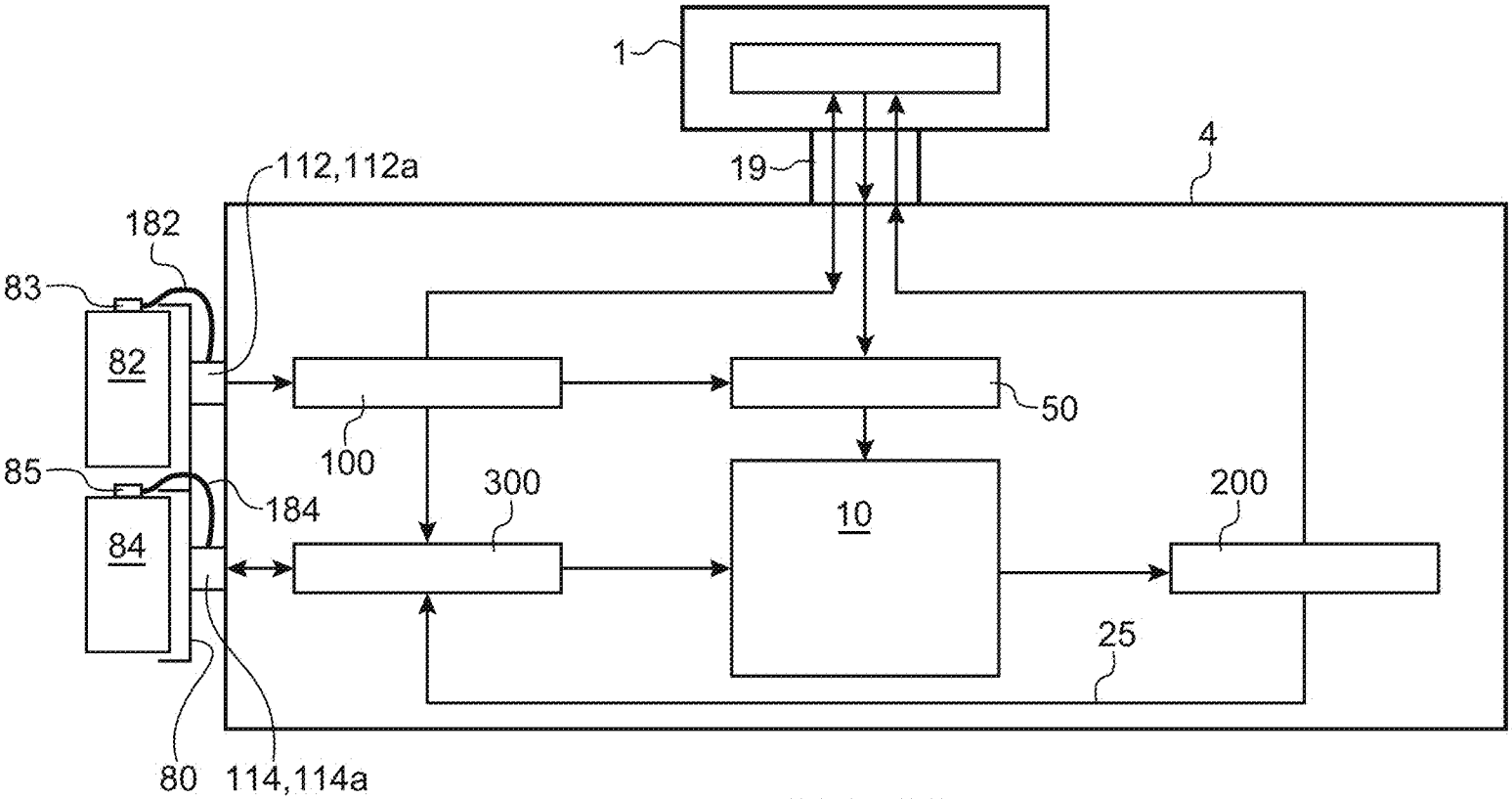
FIG. 12 represents the same fluid circuit, used with a device according to the present invention.

FIG. 12 represents the same circuit as FIG. 11, but in which the cartridges 30, 40 have been removed, replaced with the cans 82, 84, disposed on the support 80 (itself schematically represented). The rest of the fluid circuit 4 is identical to that of FIG. 11. References 83, 85, 112, 114, 112*a*, 114*a*, 112*c*, 114*c* designate the same elements as in the previous figures.

Thereby, it is possible to make, during washing or rinsing operations for example:

a) a washing or rinsing of the means 50, no solvent being during this time sent to the means 300 or to the head 1;

b) and then, possibly, a washing or rinsing of the means 300, no solvent being during this time sent to the means 50 or to the head 1;

c) and then, possibly, a washing or rinsing of the head 1, no solvent being during this time sent to the means 50 or 300.

The order of steps a), b), c) can be different from that set forth above. In the 3 cases, the solvent comes from the can 82.

Alternatively, with the same means, it is possible to send solvent to all the means making up the ink circuit, for example for an overall rinsing of the circuit.

Each of the means 50, 100, 200, 300 described above is provided with a pump which enables the fluid concerned to be treated (respectively: $1^{st}$ pump, $2^{nd}$ pump, $3^{rd}$ pump, $4^{th}$ pump). These different pumps provide different functions (those of their respective means) and therefore are different from each other, even if these different pumps are of the same type or of similar types (in other words: none of these pumps provides 2 of these functions).

In particular, the means 50 include a pump ($1^{st}$ pump) which enables the fluid, recovered, as explained above, from the printing head, to be pumped and to be sent to the main tank 10. This pump is dedicated to the recovering of this fluid from the printing head and is physically different from the $4^{th}$ pump of the means 300, which is dedicated to the ink transfer or from the $3^{rd}$ pump of the means 200 which is dedicated to the pressurising of the ink at the outlet of the tank 10.

The means 100 include a pump (the $2^{nd}$ pump) which enables solvent to be pumped and sent to the means 50 and/or the means 300 and/or to the printing head 1.

Figure 13:
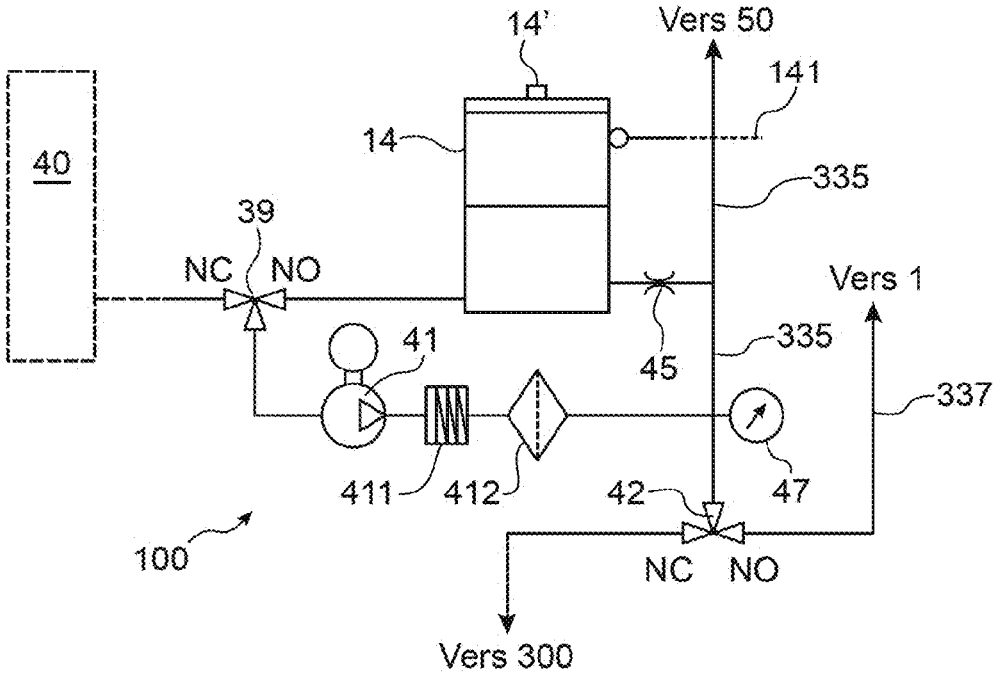
FIGS. 13-16 represent examples or aspects of parts of a fluid circuit of a CIJ type printer in which a device according to the present invention can be used.

FIG. 13 illustrates a more detailed representation of the means 100 which enable solvent to be taken from a can 82 and to send it to the different parts of the device to perform washing or unplugging operations.

These means include a pump 41 (the $2^{nd}$ pump) and various fluid connection means, each including one or more ducts or one or more valves 39, 42. One of these valves, the valve 42, enables the solvent to be oriented to 2 possible ways, that is the printing head 1 or the ink supply circuit 300. In the latter case, when the means, which enable the solvent to enter the means 300, are themselves closed, the system is oriented to the means 50. An anti-pulsatory device 411 and a filter 412 can also be found, in series with the pump.

An intermediate tank 14 can also be provided, which can be provided with level measuring means 14', and which can be supplied from a cartridge 40, when this is connected to the circuit.

This tank 14 enables solvent to be sent to the various means 50, 300 and/or to the printing head 1 and/or the main tank 10, in order to wash them or unplug hydraulic components thereof. Solvent can also be taken from the can 82 and be directly sent to the various elements of the circuit, in order to perform the same operations (washing or unplugging). It is through a valve 39 that the origin of the solvent is selected. In this figure, as in the others, the positions "normally open" (=NO) and "normally closed" (=NC) of each valve are also represented. Here, if the valve 39 is in the "NC" position (FIG. 4), then the solvent is pumped from the cartridge 40, if it is in the "NO" position, then the solvent is pumped from the tank 14.

The tank 14 can be supplied from the can 82, for example a calibrated leak, or restrictor 45 disposed at the inlet thereof. This leak further participates in generating pressure. Filling the tank 14 can be performed in the following way: the valve 39 is in the "NC" position (see FIG. 13), which enables, using the pump 41, solvent to be pumped from the can 82. The valve 42 is in the closed position (NC), whereas the inlets of the means 50 and 300 are forbidden to the solvent.

It is using the valve 42 and the means disposed at the inlet of the means 50, 300, for example an inlet valve for each of these means, that the solvent can be sent to these various means 50 (via the duct 335), 300, and then, possibly, to the main tank 10, and/or to the printing head 1 (via the duct 337). At the outlet of the means 100, 3 parallel ways can thus be defined which, if needs be, will enable solvent to be sent to either and/or both these elements.

The means 100 can also include pressure sensor forming means 47, which enable the pressure of the solvent at the outlet of the pump 41 and the means 411, 412 to be measured. This piece of information could be used to detect an increase in the solvent pressure, which can reflect a plugging of one of the ducts in which the solvent circulates.

Figure 2:
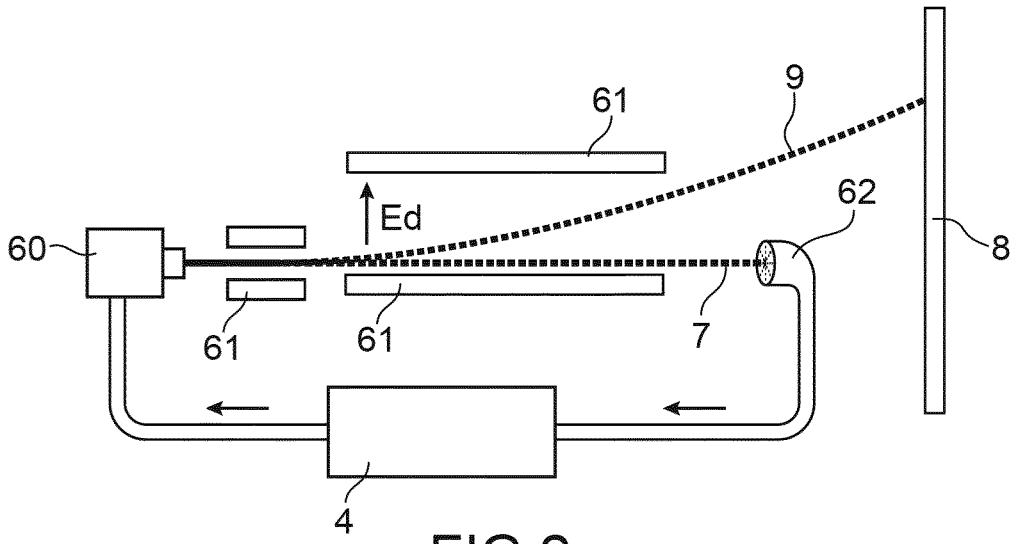
FIG. 2 represents a known structure of a printing head of a CIJ type printer.
Figure 3:
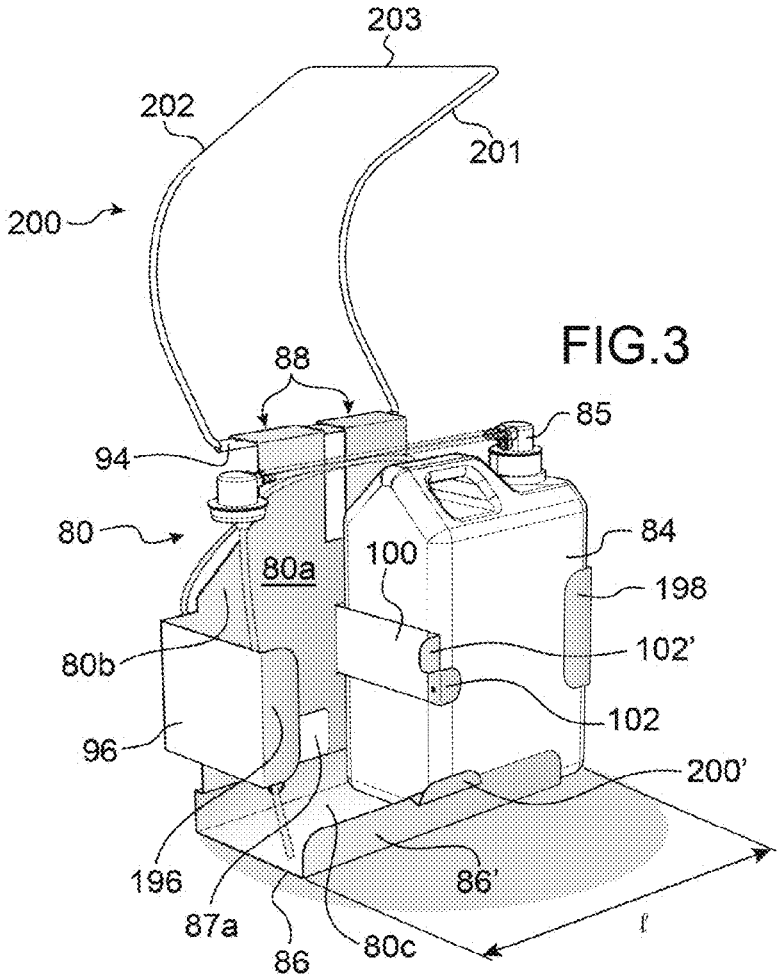
FIG. 3 is an exemplary device according to the present invention.
Figure 14:
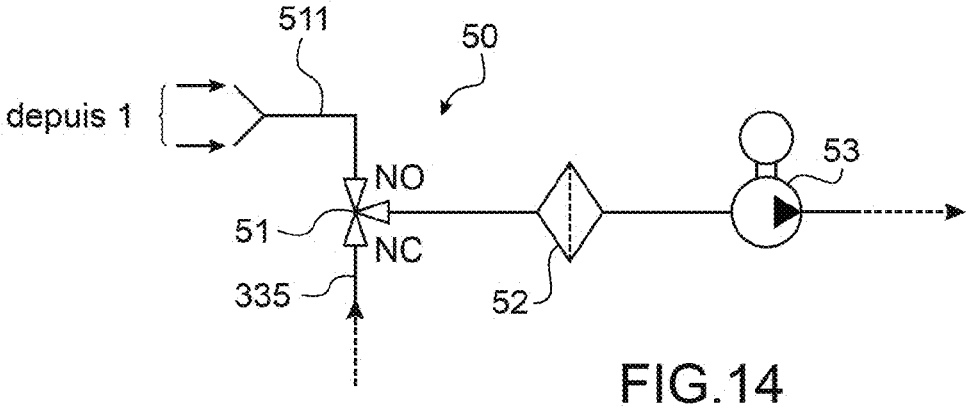

FIG. 14 illustrates a more detailed representation of the means 50 which enable fluids (ink and/or solvent) which come from the printing head to be recovered. 2 types of fluid can thus be gathered at the inlet of these means 50: ink that comes from the recovery gutter 62 (see FIG. 2) and solvent, which has been used to wash or rinse the printing head 1 and/or the umbilical 19. A duct 511 directs these fluids to the inlet of the means 50.

The latter include a pump 53 (the 1$^{st}$ pump), possibly a filter 52 disposed in series with the same, for example upstream of the pump, and inlet valve forming means 51. These means 51 include one or more valve(s), preferably a three-way valve.

They make it possible to send, to the pump 53, exclusively either fluid that comes from the head 1 (NO position of the valve in FIG. 5), via the duct 511, or solvent from the means 100 (NC position of the valve in FIG. 5) via the duct 335.

The fluid pumped by the pump 53 can then be sent to the main tank 10.

Figure 15:
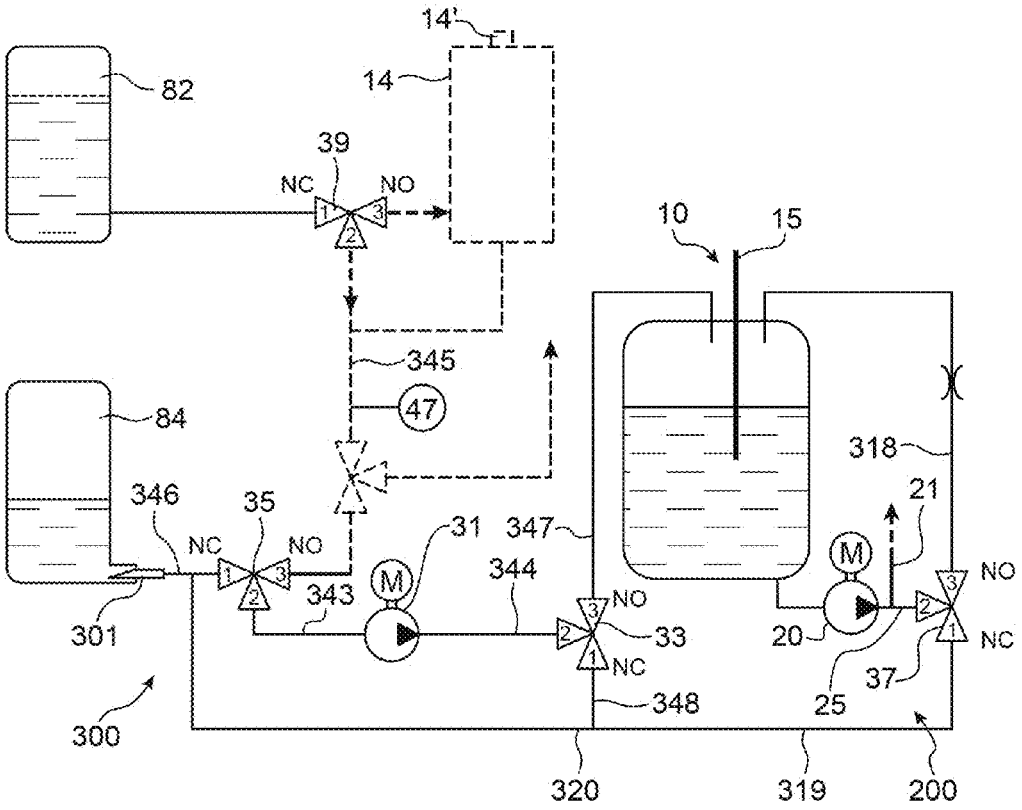

FIG. 15 illustrates a more detailed representation of the means 300, in cooperation with the main tank 10 and the means 200.

The main tank 10 is preferably provided with means 15 for detecting the ink level (indeed, ink is mixed with solvent therein) it contains.

Reference 301 designates the cannula (or any equivalent means), which will make it possible to connect, in a fluid point of view, a cartridge 30 to the rest of the circuit; here, it connects the can 84, which has replaced the cartridge 30, to the rest of the circuit.

In use during a printing, when a cartridge 30 is in place and contains ink, ink can be pumped, using the pumping means 31 (4$^{th}$ pump), to the main tank 10 via the fluid connection means, including ducts 346, 343, 344, 347 and one or more valve(s) (or solenoid valves) 33, 35, which can be "3-ways" type valves. Thus, the ink transfer pump 31 pumps ink, from the cartridge 30, which passes successively, via the valves 35 and 33 (respectively in the "12" or "NC" positions, and the "23" or "NO" positions, in FIG. 15), and through the ducts 343, 344, 347 to arrive in the main tank 10.

The NO (respectively NC) state of the valve 35 corresponds to the "23" (respectively "12") position and relates the ducts 345 and 343 (respectively 346 and 343).

At the inlet of the means 300, means 345, 35, for example a duct and a valve respectively (when the same is in the "32" (NO) position in FIG. 15), will enable solvent to be received from the means 100. The means 300 can bring this solvent to a pressure, for example between, in gauge pressure, 0 and 5 bar, or between 0 bar and 10 bar, in fluid connection means. Depending on the opening or closing state of the valves 35 and 33, this solvent can be directed via the ducts 343, 344:

- to the tank 10 (via the duct 347, valve 35 in the "32" (NO) position, valve 33 in the "23" (NO) position); this for sending washing solvent to the tank 10;
- to the duct 320 (via the duct 348, valve 35 in the "32" (NO) position, valve 33 in the "21" (NC) position). Since the valve 37 is in the NO position, the solvent can then be directed to the can 84 through the ducts 344, 348 and 320.

The means 200, at the outlet of the main tank 10, include a pump 20 (3$^{rd}$ pump, called a pump for pressurising ink) which enables ink, or the fluid it contains, to be pumped, from the main tank 10, and this fluid can be directed either to the main tank itself (via a return duct 318) or, via one or more ducts 319, 320, to the can 84 itself (and up into the same). The ink path at the outlet of the pump 20 can be controlled using one or more valves 37, preferably a 3-way valve. In FIG. 15, the "21" ("NC") position of the valve 37 enables the fluid to be directed to the duct 319, the "23" ("NO") position to the duct 318. Fluid can be sent to the printing head 1, via a duct 21, which takes it downstream of the pump 20, from a point disposed between the outlet of the pump 20 and the valve 37. The printing head contains itself a valve which enables to allow, or not, the production of an ink jet and, possibly, a printing.

Generally, instructions, for activating the pumps and valves are sent and controlled by the control means 3 (also called "controller") already described above. In particular, these are the instructions that will enable solvent under pressure to be circulated, from the means 100, towards various other means 1, and/or 50, and/or 300 of the circuit (and possibly, via the latter means 300, to the main tank 10).

The control means 3 drive the opening and closing of each valve, as well as the activation of the pumping means, in order to circulate ink and/or solvent according to what is described in the present application. It also ensures data storage, for example ink and/or solvent level measurements data, and their possible processing. The controller is also programmed to manage operations other than those of washing, in particular printing operations.

Figure 16:
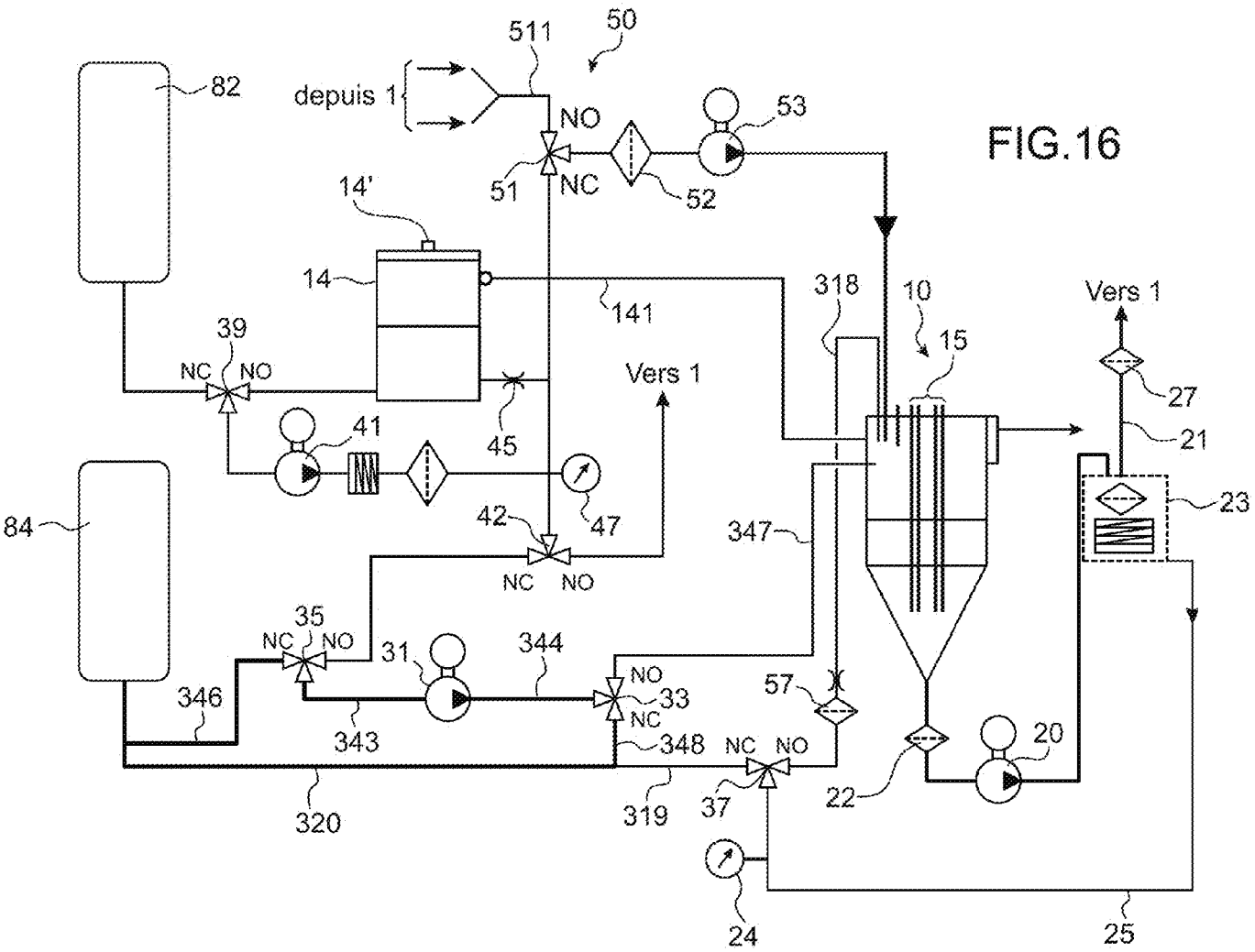

An ink circuit in which the circuits and methods described above, in particular in connection with FIGS. 3-15 can be used, is illustrated in FIG. 16. The different means 10, 50, 100, 200, 300 described above are combined herein.

Reference numerals identical to those of the preceding figures designate identical or corresponding elements therein.

At the outlet of the main tank 10, are disposed a filter 22, and then the pump 20 and an anti-pulsatory device 23. A pressure sensor 24, and possibly a temperature sensor, can be provided, as illustrated in the figure: the data it provides serve to the controller to regulate the ink pressure at a set point, generally when the ink jet speed in the head is not available (for example when the jet ejection is stopped, or when the jet speed is not measurable). As already indicated above, the ink is sent to the printing head 1, via the duct 21, connected downstream of the anti-pulsatory device 23, between the pump 20 and the valve 37. The printing head contains itself a valve which enables to allow, or not, the production of an ink jet and, possibly, a printing.

The ink is filtered by the main filter 27 downstream of the sensor 24 before it is sent to the head 1.

The intermediate tank 14 has already been described above. A duct 141 enables the free volume, located above each of the liquids contained in the tanks 10 and 14, to be put at the same atmospheric pressure.

It can be noticed that, when the valve 42 is in the "NC" position whereas the valve 35 is in the "NC" position, solvent circulation is blocked, both in the direction of the cartridge 30 and in the direction of the duct 343; the solvent is thus oriented to the valve 51 or to the restrictor 45 (to enter in the intermediate tank 14 thereby).

The invention has a particularly interesting application in the case of an ink containing dispersions of dense particles such as metals or metal oxide pigments, for example, titanium, zinc, chromium, cobalt or iron (such as $TiO_2$, ZnO, $Fe_2O_3$, $Fe_3O_4$, . . . ) as micron or sub-micron particles. Such a pigmented ink can, for example based on $TiO_2$, be used for labelling and identifying black or dark supports.

But it is also interesting in the case of any not pigmented ink which, as already explained, can dry and form dry material deposits in ducts and connections of the ink circuit.

The invention claimed is:

1. A solvent or ink container plug including:

a cylindrical base having an upper side and a lower side, the lower side being configured to face an inside of a container when the container is closed by the plug; and a connection portion, connected to the upper side of the cylindrical base, the connection portion comprising at least two connection tips, wherein the cylindrical base comprises a first aperture and a second aperture provided at the lower side of the cylindrical base, wherein the first aperture and second aperture are each in communication with a corresponding one of the two connection tips, and wherein the connection portion has a side dimension, measured in a plane perpendicular to an axis of introducing the plug onto or into the container, that is smaller than the cylindrical base.

2. The solvent or ink container plug according to claim 1, wherein the connection portion comprises a third aperture in communication with atmospheric pressure.

3. The solvent or ink container plug according to claim 2, wherein the cylindrical base further comprises a fourth aperture in communication with the third aperture.

4. The solvent or ink container plug according to claim 2, wherein the third aperture is sealed by a seal.

5. The solvent or ink container plug according to claim 1, wherein the cylindrical base is configured to be screwed onto or into an aperture of a container to seal it.

6. The solvent or ink container plug according to claim 1, further including a duct mounted on one of the two connection tips for connecting said one of the two connection tips with a fluid connection.

7. The solvent or ink container plug according to claim 1, wherein at least one of the two connection tips comprises a hose barb.

8. The solvent or ink container plug according to claim 1, further comprising a connector that defines one of the first aperture and second aperture.

9. The solvent or ink container plug according to claim 8, wherein said connector is configured to enable a duct to be mounted thereto.

10. A set of two solvent or ink container plugs, each plug including:

a cylindrical base having an upper side and a lower side, the lower side being configured to face an inside of a container when the container is closed by the plug; and a connection portion, connected to the upper side of the cylindrical base, the connection portion comprising at least two connection tips, wherein the cylindrical base comprises a first aperture and a second aperture provided at the lower side of the cylindrical base, wherein the first aperture and second aperture are each in communication with a corresponding one of the two connection tips, and wherein the set includes a duct connecting a connection tip of one of the plugs with a connection tip of the other plug.

11. A set of two plugs according to claim 10, wherein the connection portion of at least one of said two plugs comprises a third aperture in communication with atmospheric pressure.

12. A set of two plugs according to claim 11, wherein the cylindrical base of said at least one of said two plugs, comprising a third aperture in communication with atmospheric pressure, further comprises a fourth aperture in communication with the third aperture.

13. A set of two plugs according to claim 11, wherein the third aperture is sealed by a seal.

14. A set of two plugs according to claim 10, wherein the cylindrical base of at least one of said two plugs is configured to be screwed onto or into an aperture of a container to seal it.

15. A set of two plugs according to claim 10, at least one of said two plugs further including a duct mounted on one of the two connection tips for connecting said one of the two connection tips with a fluid connection.

16. A set of two plugs according to claim 10, wherein at least one of the two connection tips of at least one of said two plugs comprises a hose barb.

17. A set of two plugs according to claim 10, wherein at least one of said two plugs further comprises a connector that defines one of the first aperture and second aperture.

18. A set of two plugs according to claim 17, wherein said connector of at least one of said two plugs is configured to enable a duct to be mounted thereto.

19. A container intended to contain solvent of an inkjet printer, with which is further associated a closing plug and a plug including:

a cylindrical base having an upper side and a lower side, the lower side being configured to face an inside of a container when the container is closed by the plug; and a connection portion, connected to the upper side of the cylindrical base, the connection portion comprising at least two connection tips, wherein the cylindrical base comprises a first aperture and a second aperture provided at the lower side of the cylindrical base, and wherein the first aperture and second aperture are each in communication with a corresponding one of the two connection tips.

20. A container intended to contain ink of an ink jet printer, with which is further associated a closing plug and a plug including:

a cylindrical base having an upper side and a lower side, the lower side being configured to face an inside of a container when the container is closed by the plug; and a connection portion, connected to the upper side of the cylindrical base, the connection portion comprising at least two connection tips, wherein the cylindrical base comprises a first aperture and a second aperture provided at the lower side of the cylindrical base, and wherein the first aperture and second aperture are each in communication with a corresponding one of the two connection tips.

* * * * *